US010011402B2

(12) United States Patent
Hui et al.

(10) Patent No.: US 10,011,402 B2
(45) Date of Patent: Jul. 3, 2018

(54) ENCASED DISPENSER

(71) Applicant: BEAUTY UNIION GLOBAL LIMITED, Chai Wan (HK)

(72) Inventors: Yi Ming Hui, Guangdong (CN); Zhi Wang, Guangdong (CN)

(73) Assignee: BEAUTY UNION GLOBAL LIMITED, Chai Wan (HK)

( * ) Notice: Subject to any disclaimer, the term of this patent is extended or adjusted under 35 U.S.C. 154(b) by 0 days.

(21) Appl. No.: 15/620,200

(22) Filed: Jun. 12, 2017

(65) Prior Publication Data

US 2017/0275060 A1 Sep. 28, 2017

Related U.S. Application Data

(63) Continuation of application No. 14/767,729, filed as application No. PCT/IB2013/002480 on Jul. 11, 2013, now Pat. No. 9,676,528.

(Continued)

(30) Foreign Application Priority Data

Nov. 8, 2012 (CN) ..... 2012 2 0585452 U

(51) Int. Cl.

| | |
|---|---|
| ***B65D 47/04*** | (2006.01) |
| ***A45D 34/02*** | (2006.01) |
| ***A45D 34/04*** | (2006.01) |
| ***A45D 40/26*** | (2006.01) |
| *A45D 34/00* | (2006.01) |
| *A45D 40/00* | (2006.01) |

(52) U.S. Cl.

CPC ..... *B65D 47/04* (2013.01); *A45D 34/00* (2013.01); *A45D 34/02* (2013.01); *A45D 34/04* (2013.01); *A45D 40/26* (2013.01); *A45D 2034/007* (2013.01); *A45D 2040/0012* (2013.01)

(58) Field of Classification Search

CPC ..... B65D 47/04; A45D 40/26; A45D 34/04; A45D 34/00; A45D 34/02; A45D 2034/007; A45D 2040/0012

See application file for complete search history.

(56) References Cited

U.S. PATENT DOCUMENTS 3,718,165 A 2/1973 Grothoff ..... B65B 3/04 137/583
3,844,450 A 10/1974 Johnson ..... A47J 41/0016 222/183

(Continued)

FOREIGN PATENT DOCUMENTS

CN 201055827 Y * 5/2008 ..... B05B 11/0056
CN 101289126 A 10/2008

(Continued)

*Primary Examiner* — Donnell Long
(74) *Attorney, Agent, or Firm* — William Dippert; Laurence Greenberg; Werner Stemer

(57) ABSTRACT

An encased dispenser comprising a casing and a dispenser is provided. The casing comprises a cap and a cover. The dispenser comprises a top part and a bottom part. The top part comprises a dispensing mechanism. The casing and the bottom part are engaged to each other, and the cap and the top part are engaged to each other. The engagement of the casing to the bottom part is stronger than the engagement of the cap to the top part, and the encased dispenser excludes threading.

17 Claims, 7 Drawing Sheets

Related U.S. Application Data

(60) Provisional application No. 61/814,377, filed on Apr. 22, 2013.

(56) References Cited

U.S. PATENT DOCUMENTS

| | | | | |
|---|---|---|---|---|
| 4,750,532 | A | 6/1988 | Grothoff | B05B 9/0838 141/113 |
| 5,586,694 | A | 12/1996 | Breidenbach | A45D 34/02 222/183 |
| 6,435,231 | B1 | 8/2002 | Cooper | B65D 81/3211 141/107 |
| 6,857,806 | B2 | 2/2005 | Harrison | A45D 34/041 401/208 |
| 8,695,896 | B2 | 4/2014 | Tu | B05B 11/0056 141/113 |
| 8,978,938 | B2 | 3/2015 | Hui et al. | |
| 2004/0159677 | A1 | 8/2004 | Hwang | |
| 2012/0136748 | A1* | 5/2012 | Shasteen | A45D 33/18 705/26.5 |

FOREIGN PATENT DOCUMENTS

| | | | |
|---|---|---|---|
| CN | 202276969 | U | 6/2012 |
| CN | 202321216 | U | 7/2012 |
| EP | 2383204 | A1 | 11/2011 |

* cited by examiner

ENCASED DISPENSER

CROSS-REFERENCE TO RELATED PATENT APPLICATIONS

This application is a continuation of co-pending U.S. patent application Ser. No. 14/767,729, which in turn is a National Phase filing under 35 U.S.C. § 371 of International Patent Application No. PCT/IB2013/002480, filed Nov. 7, 2013, which is based upon Chinese Patent Application No. 201220585452.7, filed Nov. 8, 2012, and claims the benefit of the priority of the filing date of U.S. Patent Application Ser. No. 61/814,377, filed Apr. 22, 2013, each of which is incorporated herein in its entirety.

FIELD OF THE INVENTION

The present invention relates to dispensers. More particularly, the present invention relates to a case including a changeable cover and a changeable cap for a matching dispenser especially for cosmetic products such as perfumes, aftershaves, creams, etc.

BACKGROUND OF THE INVENTION

Some commercially available dispensers for perfumes, aftershave and similar products are covered with protective and/or decorative cases. Such parts typically include a protective/decorative cover on a bottom portion of the bottle, a fixed cover that cannot be changed, and a protective/decorative detachable covering cap, that may match the cover in style, and allows easy dispensation of the liquid—see for example http://www.amazon.com/Travalo-Travel-Refillable-Refills-Fragrance/dp/B002FQKKBQ.

In contrast to the cap on the top portion of the dispenser, the cover of the bottom portion does not need to be removed every time the dispenser is used. Nevertheless, there could be times at which it may be useful to remove the cover, for example to replace a worn-out or broken cap and/or cover with a matching case of a new cap and cover. In a further example, in refillable dispensers it may be useful to have the possibility to remove or substitute the cover since the refilling mechanism is not easily accessible when covered. A problem with such putative structures would be that the more frequent attempts to remove the cap for dispensing might instead remove the cover, which would be annoying and time consuming and not allow to properly use the dispenser.

U.S. Pat. No. 5,586,694 ("Perfume applicator with replaceable cartridges") describes a perfume dispenser with threaded covers which are screwed onto threads positioned at the dispenser. Such type of covers requires correct alignment of threads on the cover and on the dispenser in order to allow the screwing of the cover onto the dispenser which may take some time.

There is an unmet need for dispensers with both a changeable cover and a changeable cap that can be easily used according to the desire of the user that can allow for example to differentiate between products.

It should be noted that reference to the use of perfume as an example below doesn't limit the invention, and the current invention can be applied to any refillable liquid.

SUMMARY OF THE INVENTION

According to one aspect, an encased dispenser comprising a casing and a dispenser is provided, wherein:

the casing comprises a cap and a cover;

the dispenser comprises a top part and a bottom part;

the top part comprises a dispensing mechanism;

the casing and the bottom part are engaged to each other; and the cap and the top part are engaged to each other;

the encased dispenser characterized by:

engagement of the casing to the bottom part being stronger than engagement of the cap to the top part, and the encased dispenser excluding threading.

In some embodiments the dispenser further comprises a ledge positioned between the top part and the bottom part, wherein the ledge prevents operation of the dispensing mechanism when the cap is engaged with the top part.

In some embodiments the dispenser further comprises a refill mechanism in the bottom part, and the cover is configured to allow refilling the encased dispenser via the refill mechanism.

In some embodiments the cover comprises an aperture through which the dispenser is refillable.

In some embodiments, the dispenser further comprises a ledge positioned between the top part and the bottom part, and wherein the ledge prevents operation of the dispensing mechanism when the cap is engaged with the top part, and allows the refill mechanism to be essentially flush with the aperture.

In some embodiments the cover has at least one dispenser bottom protrusion; and the bottom part has thereon a lip;

wherein the bottom protrusion and the lip are situated relative to each other such that in order to pull apart the cover from the dispenser, the cover protrusions have to be forced over the lip.

In some embodiments the bottom part has at least one dispenser bottom protrusion; and the cover has therein a lip;

wherein the bottom protrusion and the lip are situated relative to each other such that in order to pull apart the cover from the dispenser, the dispenser bottom protrusions have to be forced over the lip.

In some embodiments when the cover is completely slid onto the dispenser bottom part, the protrusions are essentially flush with the lip.

In some embodiments the top part has at least one dispenser top protrusion; the encased dispenser configured to allow easily sliding the cap onto the dispenser to engage the protrusion with the cap.

In some embodiments the cap has at least one protrusion; the encased dispenser configured to allow easily sliding the cap onto the dispenser to engage the protrusion with the top part.

In some embodiments both cap and cover have a shape capable of providing stable placing of the encased dispenser standing up on a horizontal surface.

In some embodiments:

the dispenser further comprises a container fluidly connected to the refill mechanism and the dispensing mechanism;

the container comprises a gripping element with a plurality of knobs attached onto circumferential ridges of the container, and wherein a locking element having slots is capable of snapping onto the knobs.

In some embodiments the gripping element and locking element are engaged with the cover.

In some embodiments the cover further has a transparent window.

In some embodiments the cap is transparent.

In some embodiments the cover is transparent.

In some embodiments the cap and the cover are detachable.

In some embodiments the encased dispenser comprises a set of covers wherein each cover is provided with a different coloring.

In some embodiments the encased dispenser comprises a set of covers, wherein the each cover is provided with a different shape.

In some embodiments the encased dispenser comprises a set of covers, wherein each cover is provided with a different printed logo.

In some embodiments the encased dispenser comprises a set of caps, wherein each cap is provided with a different coloring.

Some embodiments comprise a set of caps, wherein the each cap is provided with a different shape.

In some embodiments the encased dispenser comprises a set of caps, wherein each cap is provided with a different printed logo.

According to another aspect, a method for attaching a cap to a dispenser having a top part with at least one dispenser top protrusion and a bottom part is provided, the method comprises the following steps:

providing a cap;

sliding the cap onto the dispenser top part; and engaging the cap and the at least one dispenser top protrusion of the top part;

wherein engaging the cap onto the dispenser excludes screwing.

In some embodiments, the method comprises the following steps:

providing an encased dispenser attached to a cap;

providing a replacement cap;

detaching the cap from the top part; and attaching the replacement cap onto the at least one dispenser top protrusion of the top part.

According to a further aspect, a method for attaching a cover to a dispenser having a top part and a bottom part with at least one dispenser bottom protrusion is provided, the method comprises the following steps:

providing a cover, having a lip;

sliding the cover onto the dispenser bottom part; and engaging the cover and the at least one dispenser bottom protrusion of the bottom part;

wherein engaging the cover onto the dispenser excludes screwing.

In some embodiments, the method comprises the following steps:

providing an encased dispenser attached to a cover;

providing a replacement cover;

detaching the cover from the bottom part; and attaching the replacement cover onto the at least one dispenser bottom protrusion of the bottom part.

According to a further aspect, a method for changing the appearance of a dispenser having a top part with at least one dispenser top protrusion and a bottom part with at least one dispenser bottom protrusion is provided, wherein the dispenser is encased in a cap and a cover, and wherein the method comprises the following steps:

providing an encased dispenser attached to a cap and to a cover;

providing a replacement cap and a replacement cover;

detaching the cap from the top part;

detaching the cover from the bottom part;

attaching the replacement cap onto the at least one dispenser top protrusion of the top part; and attaching the replacement cover onto the at least one dispenser bottom protrusion of the bottom part;

wherein the detaching of the cap requires less force than detaching of the cover.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DETAILED DESCRIPTION OF THE INVENTION

Figure 1B:
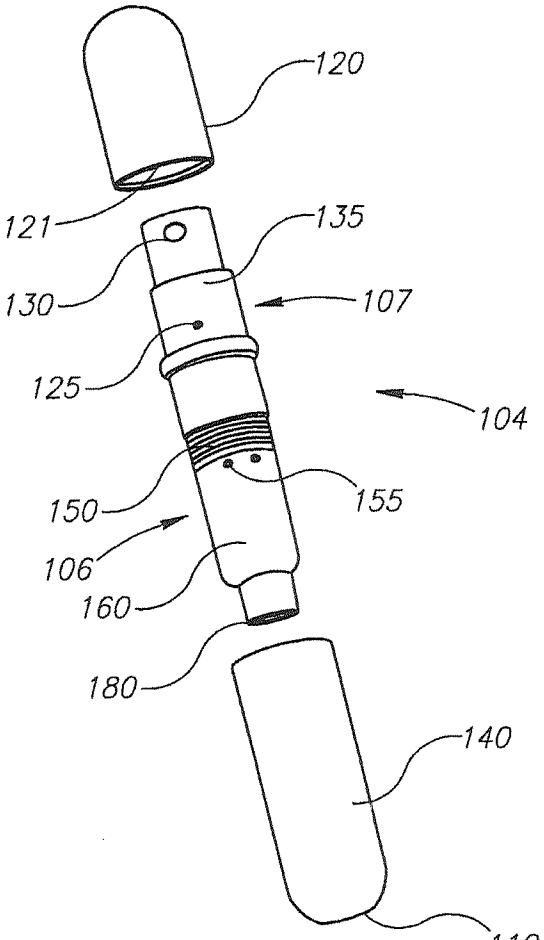
FIG. 1B illustrates an exploded perspective view of the encased dispenser, according to another exemplary embodiment.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

For clarity, non-essential elements were omitted from some of the drawings.

Figure 1A:
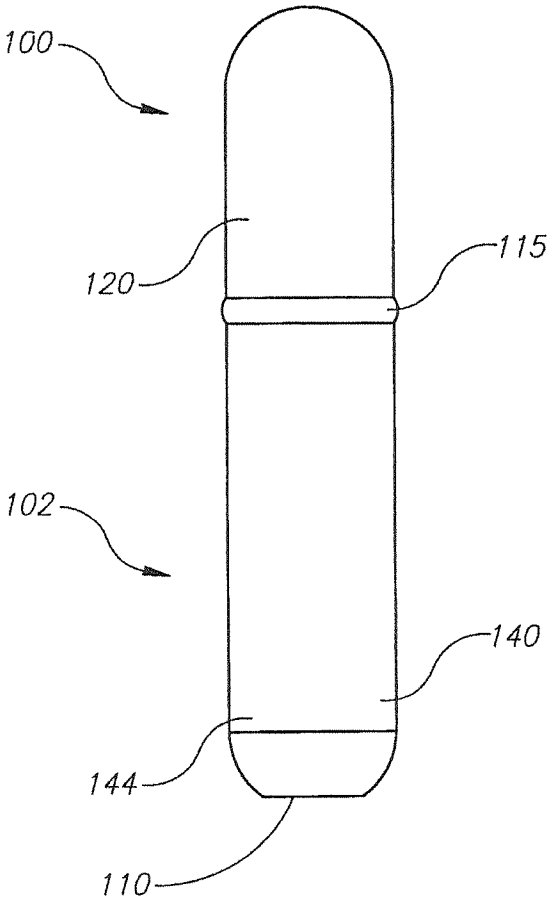
FIG. 1A illustrates a dispenser encased in a cap and a cover, according to an exemplary embodiment.
Figure 1C:
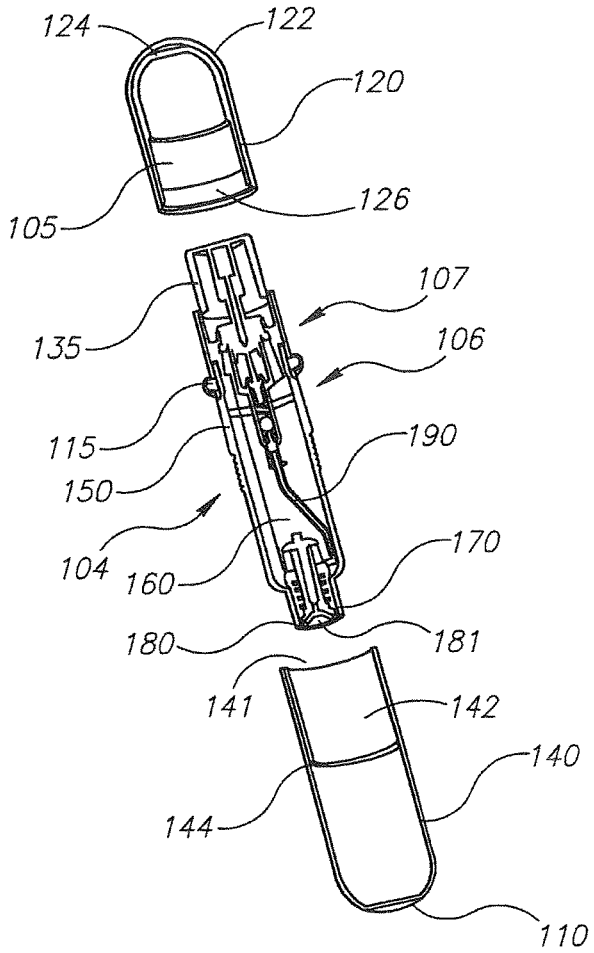
FIG. 1C illustrates an exploded cross-sectional view of the encased dispenser.

Referring now to FIGS. 1A-1C, an encased dispenser 100 comprises a casing 102 and a dispenser 104 therein. FIG. 1A shows the casing 102 with the dispenser inside—the only part of the dispenser 104 that is visible is the ledge 115. FIG. 1B presents the encased dispenser 100 in exploded perspective view, and FIG. 1C presents a cross-section of the same.

The casing 102 comprises a cap 120 and a cover 140. In the embodiment 100 the cover 140 is provided with an aperture 110, through which a liquid may be inserted into the dispenser 104 via a refill mechanism 170. The dispenser 104 comprises a circumferential ledge 115, which separates between the cap 120 and the cover 140.

The ledge 115 defines a bottom part 106 and a top part 107 of the dispenser 104; a refill mechanism 170 is positioned in the bottom 106 and a dispensing mechanism 135 is positioned in the top part 107.

It is stressed in other embodiments (not shown) there is no refill mechanism and an aperture in the cover in such is superfluous.

The interior of the dispenser 104—comprising a dispensing mechanism 135, a container 160 and a refill mechanism 170—is similar to refill bottles developed by Turgeman Carmit, a co-inventor of the present invention, and to those disclosed in U.S. Pat. No. 8,079,388 ("Refill perfume bottle") as well as in European patent EP2383204 to Hui Yi Ming and Wang Zhi ("Portable chargeable spray bottle"). With both cap 120 and cover 140 assembled, the refill bottle 104 may be carried by a user with the liquid stored safely inside, in a leak-proof manner as the assembled cap 120 and the ledge 115 prevent the cap 120 from being pressed down on the dispensing mechanism 135. In some encased dispenser embodiments with a refill mechanism the ledge delimits the cover so that when the cover is pushed onto the bottom part of the dispenser (even without the cap being on the dispenser) the refill mechanism is fairly flush with the opening of the cover, so that the refill mechanism is entirely accessible yet protected from damage and the encased dispenser is aesthetically pleasing.

The cap 120 has an opening 121 which allows insertion of the dispensing mechanism 135 therein. The exterior shell 122 of the cap 120 is hard, for example metallic, and thus protective. A lining 124 inside the cap 120 is affixed to the exterior shell 122. The lining 124 has a slope 126 adjacent to the opening 121, and flaring out to the (inner wall of) exterior shell 122. The dispenser 104 has at least one small (0.5 mm height or less) dispenser top protrusion 125 on the dispenser top 107 adjacent to the ledge 115. The preferred shape of the dispenser top protrusions 125 is a spherical cap. By lightly placing the cap 120 onto the dispenser top 107, the dispenser top protrusions 125 may eventually slide up the slope 126 to engage with the lining 124.

By pulling the cap 120 up with minimal force, the cap 120 may easily be removed from the encased dispenser 100, for example in order to dispense the liquid from dispenser opening 130 or in order to change the cap 120 with a different cap.

The changeable cap 120 and cover 140 may be available in different shapes, colors, and/or with different logos printed on them. In order to differentiate between different liquids inside the container 160, the user may replace the covers for different liquids present in different dispensers. For example, the user may use a cover of one color (or logo) for one liquid, and use a different cover with a different color (or logo) for a second liquid, in order to differentiate between the liquids inside different encased dispensers 100.

The user may also use different caps 120 and covers 140 in a fashionable way, where the covers are selected according to the desire of the user and not in order to differentiate between different liquids. For example, the user may use one cover 140 at work and a different cover 140 on a trip depending on the desire of the user. In addition, the user may choose to use the logo of a certain brand (e.g. of perfume) while the liquid inside the container 160 belongs to a different brand if the user wishes to disguise the brand (e.g. of perfume) inside the encased dispenser 100.

The liquid may be stored in container 160, and a tube therein 190 may be used to transfer the liquid therethrough from the container 160 to the dispensing mechanism 135 at the top portion 107.

The dispenser bottom 106 further comprises dispenser bottom protrusion/s 155, similar in size to dispenser top protrusion/s 125.

On the inside of the cover 140 is an inner sleeve 142 affixed to the cover 140. The sleeve has a circumferential lip 144 located at an edge of the sleeve 142 distal to the ledge 115. Beyond the lip 144 (distal to the opening 141) the inside of the cover 140 is without a sleeve, and thus the inner diameter of the cover 140 in that part is wider than before the lip 144 (proximal to the opening 141).

The dispenser bottom protrusions 155 and the lip 144 are situated (both radially and axially) relative to each other such that when the cover 140 is completely slid onto the dispenser bottom 106, such that the cover contacts the ledge 115, the dispenser bottom protrusions 155 are not facing the sleeve 142 but rather the inner wall of the cover 140, and are essentially flush with the lip 144. Thus in order to pull apart the cover 140 from the dispenser 104, the dispenser bottom protrusions 155 have to be forced over the lip 144.

To replace the cover 140 on the dispenser, the cover 140 is slid over the dispenser bottom 106. When the dispenser bottom protrusions 155 reach the lip 144 they have to be forced over the lip 144. Note that placing the cover 140 onto the dispenser 104 should be easier to perform than the removing, and this may be accomplished due to two factors: first, the "step" of the lip 144 that needs to be overcome when pushing on the cover 140 is small relative to the "step" to overcome when pulling off the cover 140; second, pushing does not require firmly grasping the cover 140 and the dispenser 104, as does the pulling.

In contrast to dispensers with threaded covers, the replacement of cap 120 or of cover 140 is carried out quickly and easily with one movement (pulling or pushing) instead of screwing the covers which may take some time.

A distal portion 180 of the refill mechanism 170 is positioned at the bottom of container 160. Container 160 may be filled with liquid through the portion 180, and the opening 181 to portion 180 is exposed through aperture 110 when the casing 102 is assembled so as to allow refilling of the encased dispenser 100 without having to remove any part of the casing 102. The cover 140 may therefore be removed only due the desire of the user as its removal is not required for filling the container 160 with liquid.

In contrast to use of the cover 140, the cap 120 must be removed for the dispensing of the liquid and therefore the removal of the cap 120 is easier.

The dispenser 104 further comprises ridges 150. The ridges may serve as grasping surfaces for helping to place the cap 120 onto the dispenser 104 and as surface that further resist the removal of the cover 140.

In another embodiment (not shown), the liquid is dispensed from the top of the dispenser with a vaporizer adapted to allow spraying the liquid out.

In a further embodiment (not shown), the liquid is dispensed from the the top portion of the dispenser with a roll-on mechanism.

In a further embodiment (not shown), the bottom of the container snugly fits into the aperture of the cover, and extends through the cover.

In a further embodiment (not shown), the cap or the cover comprises a transparent material that for example allows seeing the level of the liquid remaining in the container 160.

Figure 2:
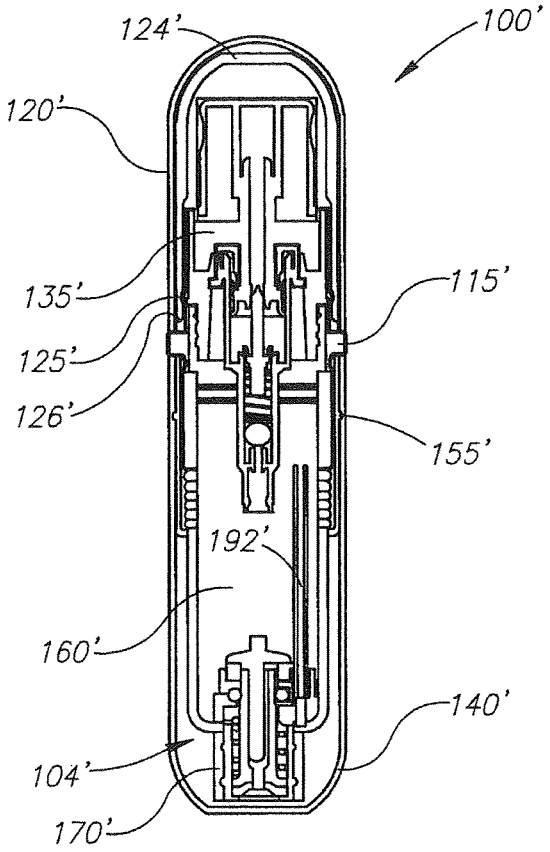
FIG. 2 shows another encased dispenser embodiment

FIG. 2 shows in cross-section an embodiment 100' similar to the embodiment shown in FIGS. 1A to 1C. The encased dispenser 100' also has a cap 120', a cover 140' and a dispenser 104', wherein the dispenser 104' comprises a ledge 115', dispenser bottom protrusions 155' and dispenser top protrusions 125', a dispensing mechanism 135' and a refill mechanism 170'. The cap 120' also includes a lining 124' with a slope 126'. However, the dispenser 104' lacks a drawing tube (see FIG. 1C) and in contrast to the embodiment 100 shown in FIGS. 1A-1C, does have a vent tube 192' for release of excess air during the refilling of the dispenser 104'.

Figures 3A, 3B:
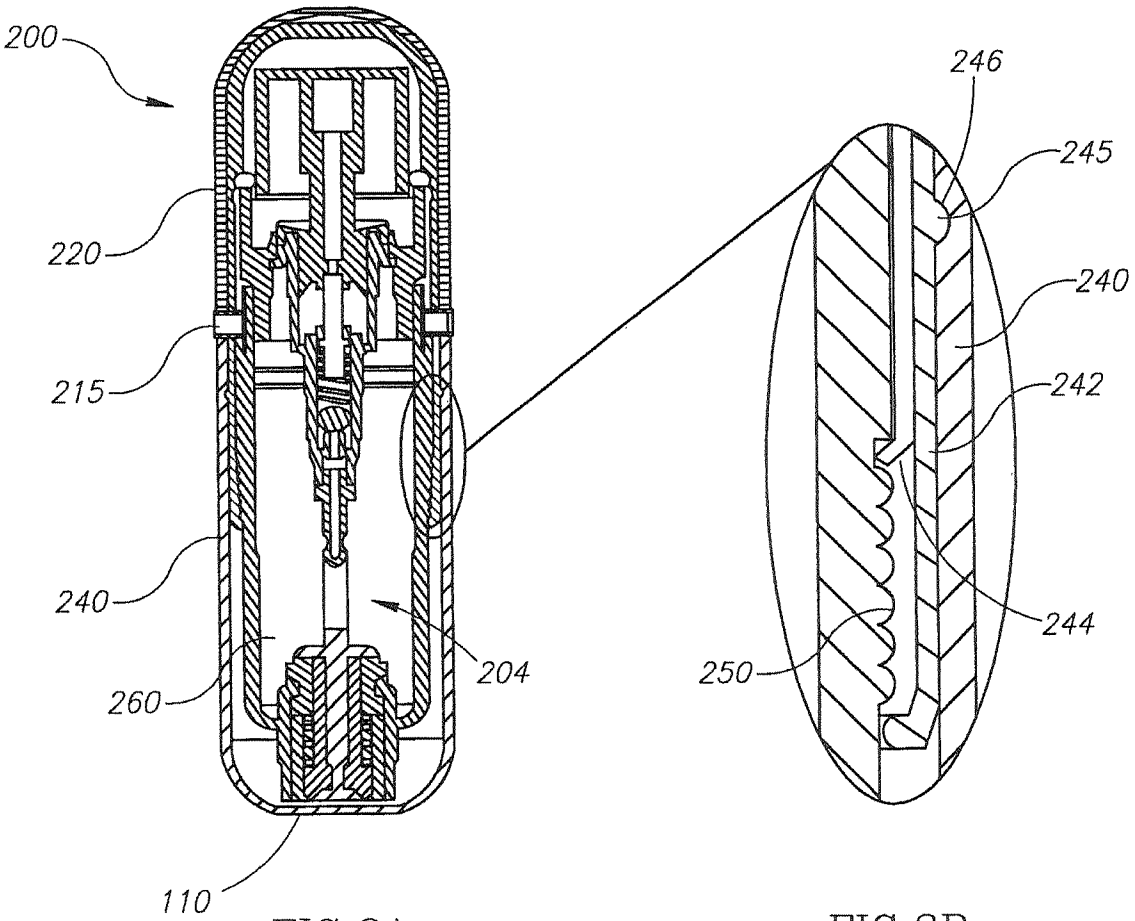
FIG. 3A illustrates a cross-sectional view of a dispenser with both cap and cover on, according to a further exemplary embodiment.
FIG. 3B shows an enlarged segment of a locking arrangement between the dispenser and the cover.

Referring now to FIGS. 3A-3B, FIG. 3A illustrates a cross-sectional view of the encased dispenser 200 with both cap 220 and cover 240 on, and FIG. 3B shows an enlarged segment of a locking arrangement between the encased dispenser 200 and the cover 240.

When the dispenser 204 is placed inside the cover 240, the ridges 250 on the container 260 may engage with projections 244 on the inside of the cover 240 and force the cover 240 to remain in its position so that only by pulling the cover 240 (with moderate force) it may be removed from the dispenser 204. A circumferential positioning ring 245 is arranged on the upper portion of the layer 242 and fits into a groove 246 in cover 240.

Figures 4A, 4B, 4C:
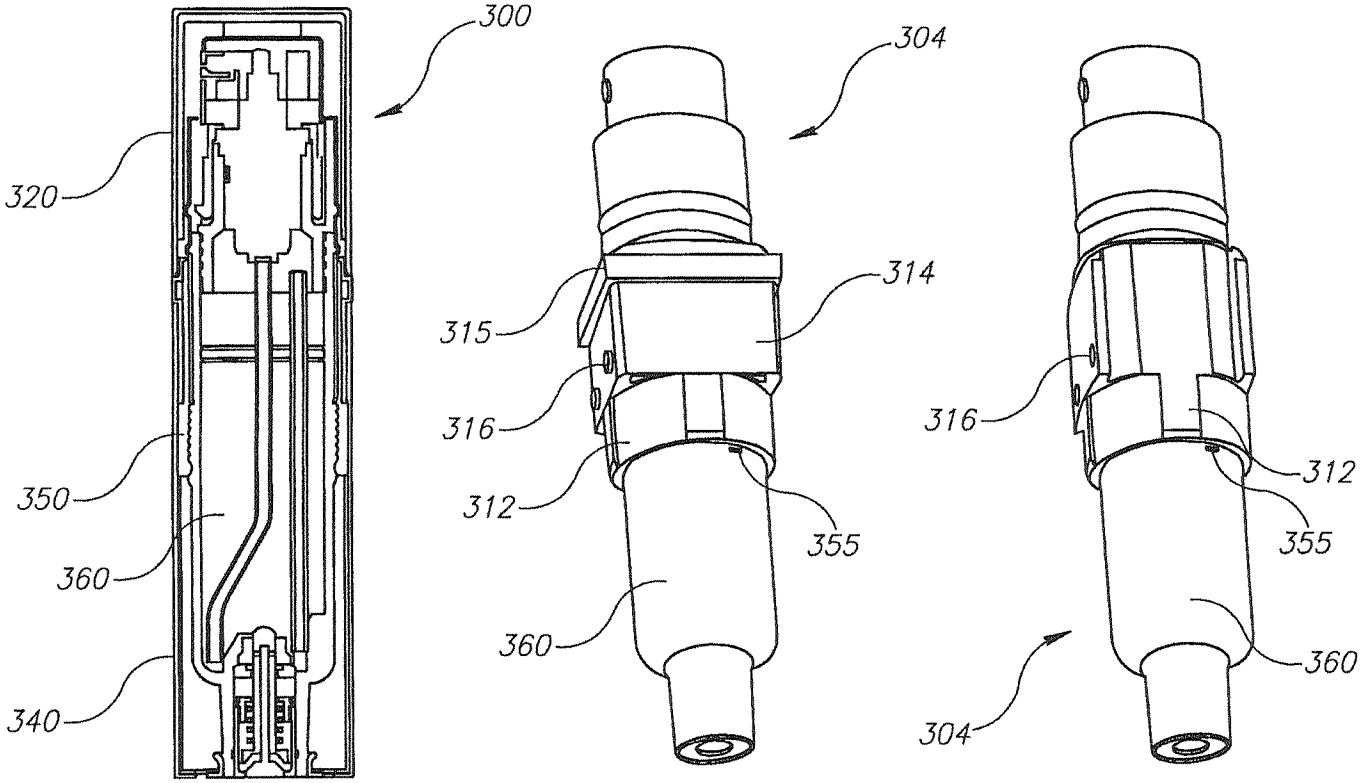
FIG. 4A illustrates a cross-sectional view of a dispenser with both a rectangular cap and a cover on, according to a further exemplary embodiment.
FIG. 4B illustrates a dispenser with both the rectangular cap and the cover removed, according to a further exemplary embodiment.
FIG. 4C illustrates a dispenser with the rectangular cap, the cover and a locking arrangement removed.

Referring now to FIGS. 4A-4C, FIG. 4A illustrates a cross-sectional view of a dispenser in a further embodiment 300, with both cap 320 and cover 340 on. In this embodiment 300 both cap 320 and cover 340 have a rectangular shape which enables placing the dispenser standing up on a horizontal surface in a stable manner, so the dispenser cannot roll off.

FIGS. 4B and 4C illustrate the dispenser 304 with both the rectangular cap 320 and the cover 340 removed from the encased dispenser 300. FIG. 4B also shows a gripping element 312 fitted onto the circumferential ridges 350 of container 360 at the middle part of the dispenser, and a locking element 314 having slots and capable of snapping onto knobs 316 located at the sides of the gripping element 312, wherein the knobs are configured to fit into the slots of the locking element 314. The gripping element 312 and locking element 314 are engaged with the top part of the cover 340, at the outer bottom part of the gripping element 312 (similar to the protrusions 155, shown in FIG. 1B). The gripping element 312 forces the cover 340 to remain in its position so that only by pulling the cover 340 (with moderate force) it may be removed from the dispenser 304. The locking element 314 has a rectangular circumferential ledge 315 at its top end, which may separate between the cap 320 and the cover 340 (similarly to ledge 115, shown in FIG. 1A).

FIG. 4C shows the gripping element 312 fitted onto the circumferential ridges 350 (shown in FIG. 4A) at the middle part of the dispenser 304, with the locking element 314 removed.

Figure 5B:
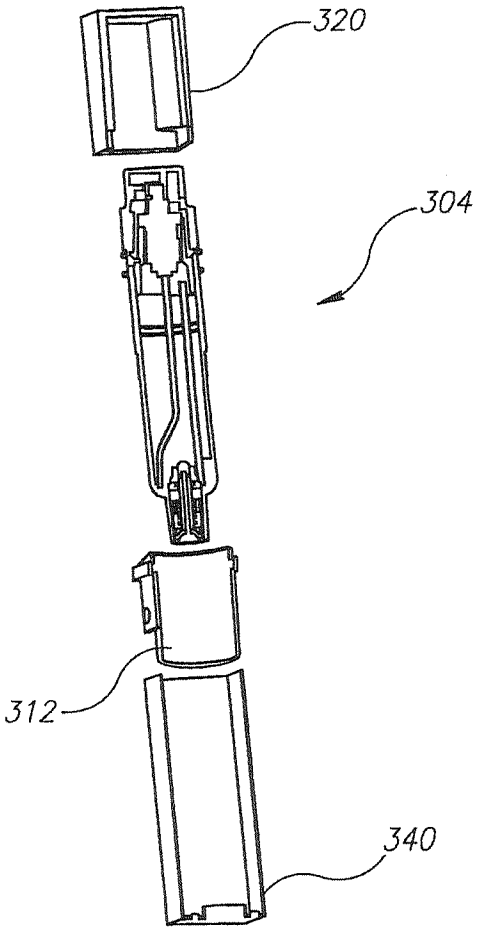
FIG. 5B illustrates a cross-sectional exploded view of the dispenser with the gripping element and the rectangular cap, cover and locking element removed.
Figure 5A:
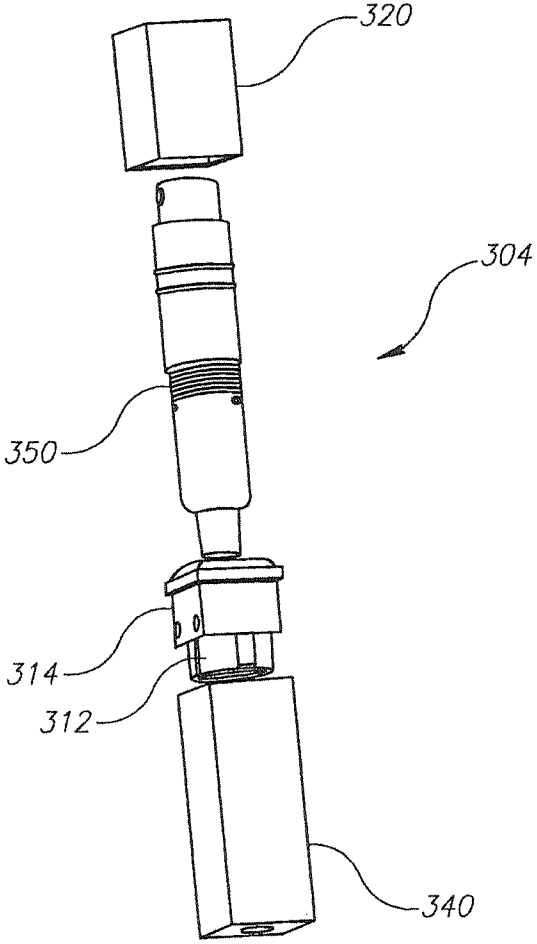
FIG. 5A illustrates an exploded view of the dispenser with a gripping element and the rectangular cap, the cover and the locking element removed, according to a further exemplary embodiment.

Referring now to FIGS. 5A-5B, FIG. 5A illustrates an exploded view of the dispenser 304, gripping element 312 and rectangular shaped cap 320, cover 340 and locking element 314. FIG. 5B illustrates a cross-sectional exploded view of the came. Once the dispenser 304 is inserted into the cover 340, the inner part of the gripping element 312 may engage the circumferential ridges 350.

In a further embodiment (not shown), the dispenser may be fitted into a cap and cover having a rectangular or a rounded shape, according to the desire of the user. In this embodiment, the user may place either type of covers due to the circumferential ridges on the dispenser which may attach to both covers, with both caps also fitted in a similar way, so that different configurations of caps and covers may be created.

Figure 6:
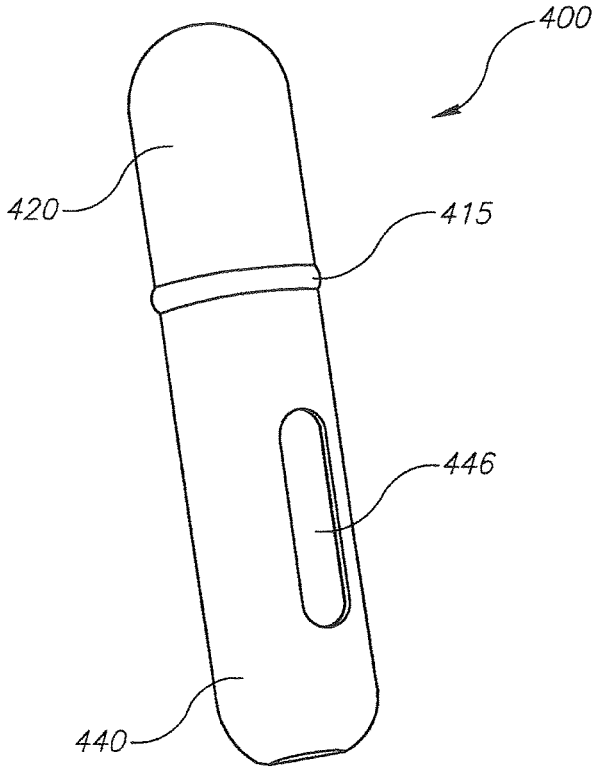
FIG. 6 illustrates the dispenser with both the cap and the cover on with an additional window at the cover, according to a further exemplary embodiment.

FIG. 6 illustrates the encased dispenser 400 in a further embodiment, with both cap 420 and cover 440 on and separated from each other by circumferential ledge 415. In this embodiment, a transparent window 446 is located at the cover 440. This cover 440 may be used so that the container (not shown) of the dispenser may be observable, without the need for removing the cover 440 (e.g. for checking the amount of remaining liquid).

In some embodiments (not shown) there are protrusions on the casing that can be engaged with the dispenser.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A dispenser configured to receive one of a plurality of casings, the dispenser comprising:

a top part that comprises a dispensing mechanism; and a bottom part that comprises a refill mechanism, wherein the casing comprises a cap and a cover to engage the top part of the dispenser and the bottom part of the dispenser, respectively, so that engagement of the cover to the bottom part of the dispenser is stronger than engagement of the cap to the top part of the dispenser, wherein when the cover is assembled onto the dispenser, the refill mechanism is exposed through the cover to allow refilling of the dispenser via the refill mechanism, and wherein the bottom part of the dispenser has at least one bottom protrusion, and the cover has an inside surface having thereon a lip, and wherein the at least one dispenser bottom protrusion and the lip are situated relative to each other such that to pull the cover apart from the dispenser, the lip has to be forced over the at least one dispenser bottom protrusion.

2. The dispenser of claim 1, wherein the dispenser further comprises a ledge positioned between the top part and the bottom part, wherein the ledge prevents operation of the dispensing mechanism when the cap is engaged with the top part.

3. The dispenser of claim 1, wherein the cover comprises an aperture through which the dispenser is exposed to be refilled.

4. The dispenser of claim 3, wherein the dispenser further comprises a ledge positioned between the top part and the bottom part, and wherein the ledge prevents operation of the dispensing mechanism when the cap is engaged with the top part, and allows the refill mechanism to be essentially flush with the aperture.

5. The dispenser of claim 1, wherein when the cover is completely slid onto the dispenser bottom part, the at least one bottom protrusion is essentially flush with the lip.

6. The dispenser of claim 1, wherein the top part of the dispenser has at least one dispenser top protrusion, and the dispenser is configured to allow easily sliding the cap onto the dispenser to engage the at least one dispenser top protrusion with the cap.

7. The dispenser of claim 1, wherein the cap has at least one protrusion, and the dispenser is configured to allow the cap to slide onto the dispenser to engage the at least one protrusion with the top part.

8. The dispenser of claim 1, wherein the casing has a shape capable of providing stable placing of the dispenser standing up on a horizontal surface.

9. The dispenser of claim 1, wherein each of the plurality of casings is provided with a different printed logo.

10. The dispenser of claim 1, wherein each of the plurality of casings is provided with a different coloring or a different shape.

11. A method for changing the appearance of a dispenser having a top part provided with a dispensing mechanism and with at least one dispenser top protrusion and a bottom part having a refill mechanism and at least one bottom protrusion, the method comprising:

providing a plurality of caps, wherein the caps have a cover lip configured to engage with the top protrusion;

providing a plurality of covers having a cover lip configured to engage with the at least one bottom protrusion wherein the engagement of the covers to the bottom part of the dispenser is stronger than the engagement of the caps with the top part of the dispenser and wherein the covers are further provided with an aperture that allows the refill mechanism to be exposed through the cover;

covering the top part with one of the caps;

covering the bottom part with one of the covers; and changing the cover or the cap by another cover or cap of the plurality of covers and the plurality of caps, respectively.

12. The method of claim 11, wherein each of the plurality of covers is provided with a different printed logo.

13. The method of claim 11, wherein each of the plurality of covers is provided with a different printed logo.

14. The method of claim 11, wherein each of the plurality of caps is provided with a different printed logo.

15. The method of claim 11, wherein each of the plurality of covers is provided with a different coloring or a different shape.

16. The method of claim 11, wherein each of the plurality of caps is provided with a different coloring or a different shape.

17. A dispenser configured to receive a casing, the dispenser comprising:

a top part that comprises a dispensing mechanism; and a bottom part that comprises a refill mechanism, wherein the casing comprises a cap and a cover to engage the top part of the dispenser and the bottom part of the dispenser, respectively, so that engagement of the cover to the bottom part of the dispenser is stronger than engagement of the cap to the top part of the dispenser, wherein when the cover is assembled onto the dispenser, the refill mechanism is exposed through the cover to allow refilling of the dispenser via the refill mechanism, and wherein the bottom part of the dispenser has at least one bottom protrusion, and the cover has an inside surface having thereon a lip, and wherein the at least one bottom protrusion and the lip are situated relative to each other such that to pull the cover apart from the dispenser, the lip has to be forced over the at least one dispenser bottom protrusion.

* * * * *